United States Patent [19]

Pagliuca

[11] 4,335,575

[45] Jun. 22, 1982

[54] EXHAUST BACK PRESSURE REDUCER FOR INTERNAL COMBUSTION ENGINE

[76] Inventor: Basilio Pagliuca, 18200 Killion, Apartment 15, Tarzana, Calif. 91356

[21] Appl. No.: 95,835

[22] Filed: Nov. 19, 1979

[51] Int. Cl.[3] ..... F01N 5/04

[52] U.S. Cl. ..... 60/319; 181/262; 181/263

[58] Field of Search ..... 60/317, 319, 308, 324; 181/262, 263

[56] References Cited

U.S. PATENT DOCUMENTS

| | | | |
|---|---|---|---|
| 1,840,862 | 1/1932 | Webb | 181/262 |
| 2,389,059 | 11/1945 | Kurth | 60/319 |
| 3,857,458 | 12/1974 | Ohtani | 60/319 |
| 4,198,817 | 4/1980 | Fujita | 60/319 |

FOREIGN PATENT DOCUMENTS

| | | | |
|---|---|---|---|
| 151557 | 5/1904 | Fed. Rep. of Germany | 60/308 |
| 252546 | 6/1926 | United Kingdom | 181/263 |

*Primary Examiner*—Douglas Hart
*Attorney, Agent, or Firm*—David O'Reilly

[57] ABSTRACT

An exhaust gas pressure reducer for an internal combustion engine which is comprised of a housing having means for attaching the housing to the end of the exhaust pipe. The housing has one or more venturi restrictions and is open at the ends for creating a draft across the end of the exhaust pipe through the venturi and out the opposite open end of the housing. The open exit of the housing reduces pressure at the exit to the venturi assisting drawing exhaust gases from the exhaust pipe.

8 Claims, 9 Drawing Figures

EXHAUST BACK PRESSURE REDUCER FOR INTERNAL COMBUSTION ENGINE

BACKGROUND OF THE INVENTION

This invention relates to devices for reducing back pressure in internal combustion engines, and more particularly relates to an exhaust gas back pressure reducer which can be attached to the exhaust pipe.

Because of the overlap condition in internal combustion engines during which intake and exhaust valves are open simultaneously for a short period, back pressure can considerably reduce efficiency. For this reason, a number of methods and devices have been provided in an attempt to reduce the exhaust back pressure. In some cases this is accomplished by separate individual exhaust pipes connected directly to the exhaust manifold for each cylinder. This is one method used in aircraft engines or internal combustion engines used in racing cars. However, this type of method does not permit any type of muffler to be used for the reduction of noise. In vehicles, such as passenger cars, used for public transportation, noise reduction is important, and therefore, mufflers must be installed which increase the length of the exhaust system and necessitate the installation of a single exhaust manifold. This, however, because of the interconnected exhaust manifold and length of exhaust pipe necessary for insulation of a muffler, increases the possibility of back pressures. Some devices for reducing exhaust gas pressure have attempted to accomplish this by scooping air into the tailpipe or exhaust conduit and mixing this air with the exhaust gases inside the tailpipe. These devices are dependent for their effectiveness upon the velocity of the air injected directly into the exhaust conduit. They effectively succeed only in offsetting any accomplished pressure reduction by increasing the pressure in the exhaust system in amount equal to or greater than the original reduction which was hoped for. Air scoops externally of the exhaust pipe have been tried, but accomplish nothing more than a mere diffusion of the exhaust gases with air at emission from the tailpipe or into exhaust conduit.

SUMMARY OF THE INVENTION

The purpose of the present invention is to provide a device for attachment to exhaust tailpipes which effectively reduces exhaust gas back pressures.

This invention provides a housing for attachment to the end of an exhaust pipe which creates a low pressure area at the exit to the exhaust pipe by drawing air through a venturi across the end of the exhaust pipe, drawing the exhaust gases out of the engine. Such a device was disclosed and described in U.S. Pat. No. 3,045,421 issued July 24, 1962 to the same inventor as the device disclosed herein. To provide an improvement to that device, a deflector is added to prevent swirling air around the exit of the exhaust gas pressure reducer housing from causing back pressure which can counteract the effect of the device. The deflector causes air flowing over the external surface of the housing to be deflected downward away from the exit of the housing, preventing any counteracting pressure against the pressure reduction caused by the venturi. This assists in allowing the exhaust gases to exit from the exhaust gas pressure reducer.

To further provide the operation of the device and to create a further reduction in pressure, a second venturi may be provided in the housing perpendicular to the first. In addition, slots in the housing between the first and second venturis provide a scoop for scooping air into the second venturi to draw the gases out and further reduce pressure. The second venturi may also be used in conjunction with the air deflector described above.

One object of the present invention is to provide an exhaust gas pressure reducer which effectively prevents counteracting pressures at the exit to the exhaust gas pressure reducer.

Another object of the present invention is to provide an exhaust gas pressure reducer with mutually perpendicular venturi throats to create and assure reduction in pressures at the exit from the exhaust pipes.

Still another object of the present invention is to provide an exhaust gas pressure reducer system for an internal combustion engine. This reduces back pressure in the exhaust system which increases the efficiency of the engine, thereby increasing gasoline mileage of the vehicle being driven by the engine.

These and other objects of the invention become apparent from the following detailed description of the invention when considered in connection with the accompanying drawings wherein like reference numbers identify like parts throughout.

DETAILED DESCRIPTION OF THE PREFERRED EMBODIMENT

The invention disclosed herein is for an exhaust gas pressure reducer which can provide increased engine efficiency and improve gas mileage. Such a device was disclosed and described in the U.S. patent referred to above, but is not as effective as it could be. In the previously described device, means for attaching the device to the end of the tailpipe were described with a housing having a single venturi throat. In this device, air was drawn into the venturi throat across the end of the tailpipe and out through the opposite end. However, air passing over the outside of the housing, because of the speed of the vehicle, can create counteracting pressures at the exit to the housing. Thus, the device, while effective, is not as efficient as it could be.

Figure 1:
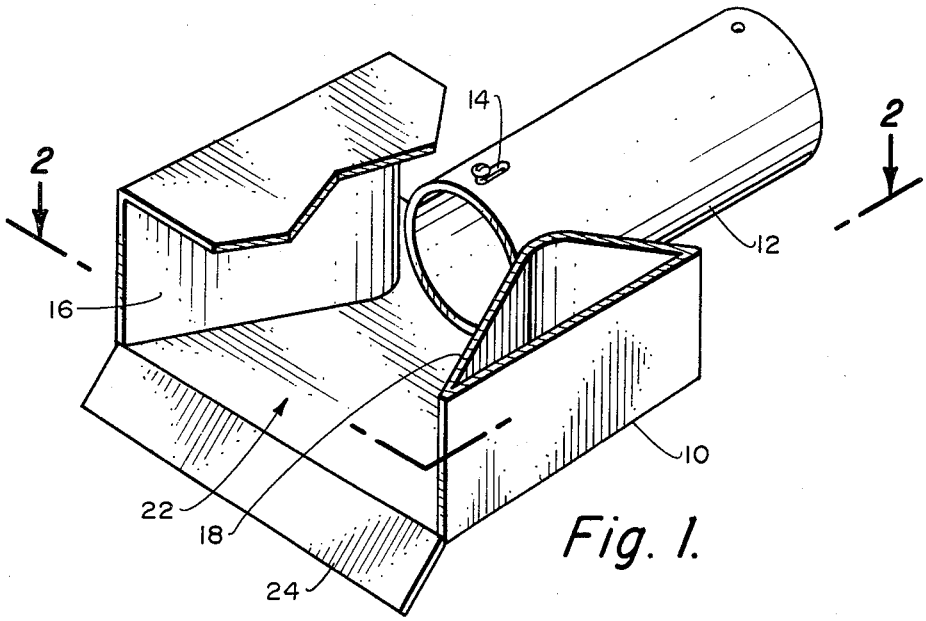
FIG. 1 is a perspective view of the exhaust gas pressure reducer partially broken away to illustrate the principle of the invention.

To prevent the effect of this counteracting pressure, several improving modifications have been provided. One of these is illustrated in FIG. 1 in which the housing 10 has a tube 12 for attaching the exhaust gas pressure reducer to an exhaust pipe. A slot 14 for adjusting the position of the housing with respect to the exhaust pipe may or may not be provided as was described in the hereinabove referenced patent. However, since the particular vehicle on which it is going to be used can be predetermined in most cases, the position of the housing on the tubular portion 12 may be fixed.

Figure 2:
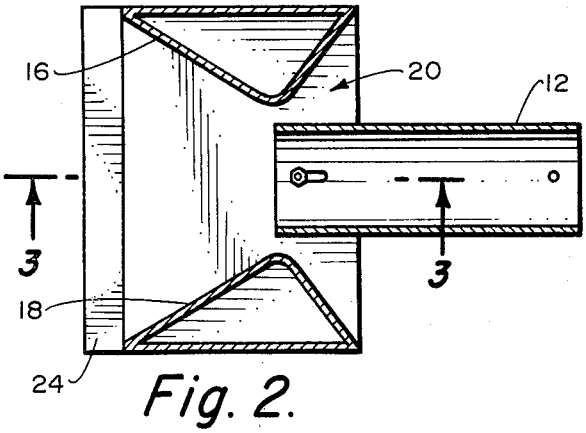
FIG. 2 is a sectional view of the exhaust gas pressure reducer of FIG. 1 taken at 2—2.
Figure 3:
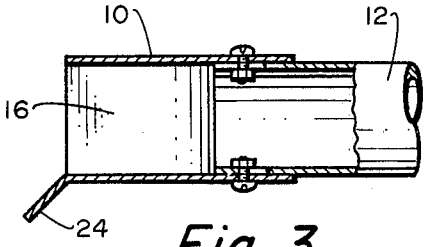
FIG. 3 is a sectional view of the exhaust gas pressure reducer taken at 3—3 of FIG. 2.

In the device illustrated in FIG. 1, the housing 10 is generally rectangular and is provided with restrictive members 16 and 18. The restrictive members 16 and 18 are shaped to form a conventional venturi as can be seen in FIGS. 1 and 2. An air scoop opening 20 is provided at the entrance to the venturi adjacent to the tube 12 which attaches to the exhaust pipe. The operation of the device described above is substantially the same as that described in the previous patent to the same inventor referred to hereinabove. A difficulty with this device, however, is the fact that air flowing over the external flat surfaces of the housing 10 can create counteracting pressures at the exit 22 to the housing. In order to minimize and prevent such counteracting pressures, a deflector 24 is provided on the edge of the housing adjacent to the exit 22. The deflector causes a downdraft at the exit 22, preventing occurrence of any counteracting pressures. If desired, another deflector, similar to that shown at 24 could be provided along the top edge.

Figure 4:
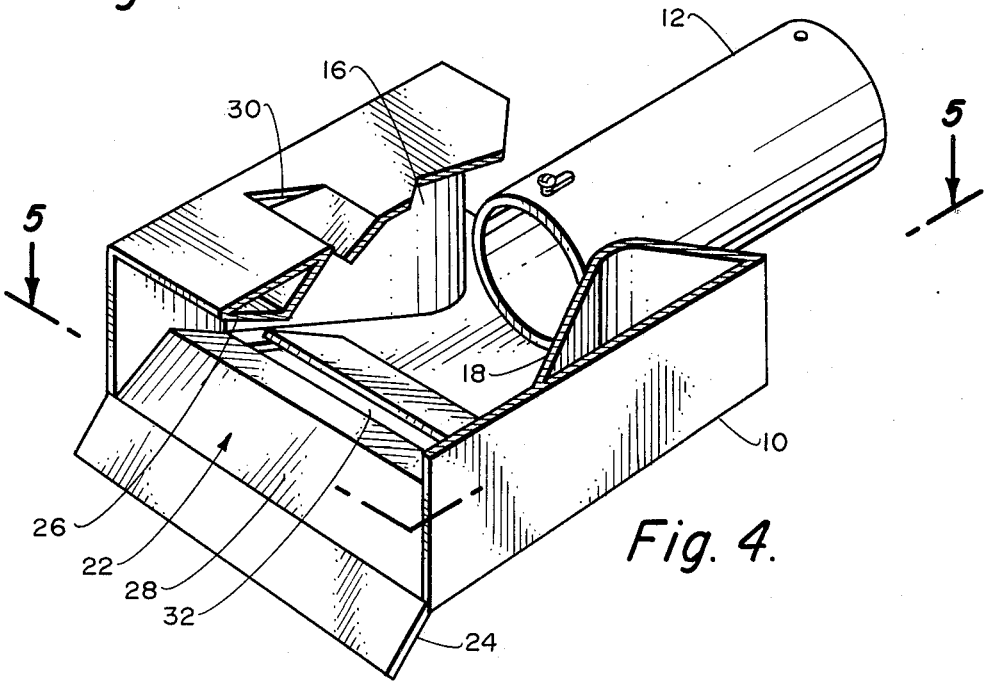
FIG. 4 is a perspective view partially broken away of a second embodiment of the exhaust gas pressure reducer of FIG. 1.
Figure 5:
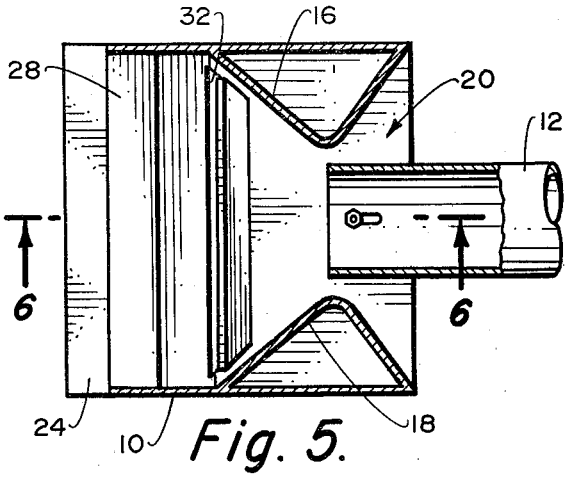
FIG. 5 is a sectional view taken at 5—5 of FIG. 4.
Figure 6:
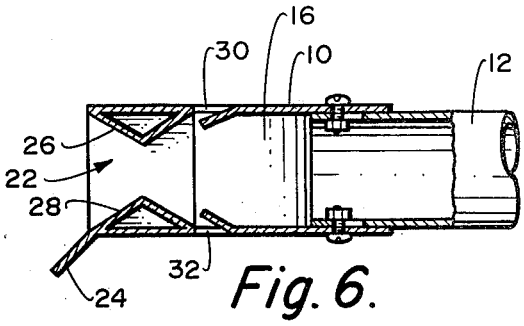
FIG. 6 is a sectional view taken at 6—6 of FIG. 5.

Another modification to improve the operation and function of the exhaust gas pressure reducer is shown in FIGS. 4 through 6. As before, the device has a housing 10 and a tube 12 for attaching the pressure reducer to the exhaust pipe. Restrictive members 16 and 18 provide a first venturi throat adjacent to the exit of the tube 12 as before. In order to provide further pressure reduction and draft out the exit 22 from the housing, a second venturi is provided by restrictive members 26 and 28. This venturi, however, is perpendicular to the first venturi to provide additional assistance in reducing pressures at the end of the exhaust pipe. Slots 30 and 32 in the top and the bottom of the housing 10 between the two venturi throats formed by restrictive members 16, 18 and 26, 28 provide air scoop for scooping air through the second venturi throat. Preferably, the air deflector 24 is also provided at the exit 22 to reduce any counteracting pressures.

Figure 7:
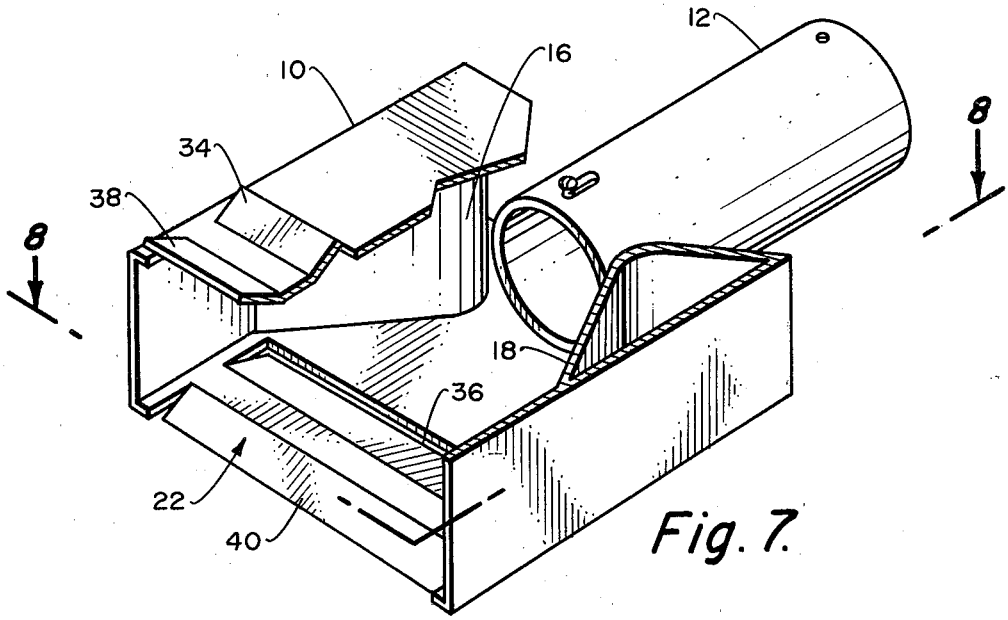
FIG. 7 is a perspective view partially broken away illustrating a third embodiment of the invention.
Figure 8:
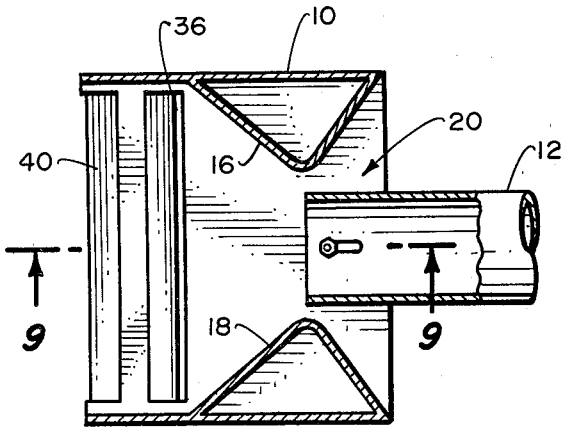
FIG. 8 is a sectional view taken at 8—8 of FIG. 7.
Figure 9:
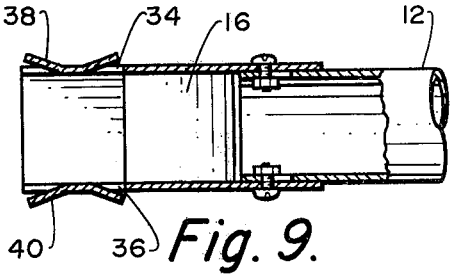
FIG. 9 is a sectional view taken at 9—9 of FIG. 8.

Another embodiment for improving the operation of the device is shown in the illustrations of FIGS. 7 through 9. In this embodiment, a rectangular housing 10 again has the tubular portion 12 for attaching the exhaust gas reducer to the tailpipe. In order to prevent counteracting pressures, an air deflector in the form of a scoop 34 in the top of the housing and a second scoop 36 in the bottom of the housing are provided. Further, upward and downward deflectors 38 and 40 are provided at the exit of the housing 22. In this embodiment, the venturi throat restrictive members 16 and 18 provide a reduction in pressure at the exit to the tailpipe while the scoops provided by slots 34 and 36 in the top and bottom of the housing and the deflection caused by flaps 38 and 40 prevent any counteracting pressure during operation of the device. The air scoops 34 and 36 are formed as an integral part of the housing 10 while the flaps 38 and 40 provided are likewise formed.

In operation of these devices, air is scooped into the entrance 20 through the venturi throat over the end of the tube 12 attached to the tailpipe. A considerable reduction in pressure (i.e. negative pressure) is caused at the exit to the tube 12 by the air drawn through the venturis thereby preventing back pressure and drawing exhaust gases from the exhaust system. Additionally, the reduction or prevention of any counteracting pressures at the exit 22 to the exhaust gas pressure reducer is prevented by one or more of the methods described above. In one form, a deflector is provided on the bottom or on the top of the housing to deflect air flowing over the outside of the housing away from the exit creating or preventing any counteracting pressures. In another form, a second venturi throat further reduces pressure and scoops in air and may be used in conjunction with the deflector. In a third embodiment, an air scoop provided integral with the top and bottom of the housing cooperates or functions with air deflectors in the top, integral with the housing in the top and bottom at the exit, preventing any counteracting pressures.

Thus, there has been disclosed and described an improved exhaust gas pressure reducing device which functions to assist in improving efficiency of an engine by creating a reduction in pressure at the exhaust of a tailpipe, while simultaneously including means to prevent any counteracting pressures at the exhaust or exit of the exhaust gas pressure reducer.

Obviously, many modifications and variations of the present invention are possible in the light of the above teachings. It is, therefore, to be understood that the proposed scope of the invention is not limited to the details disclosed herein, and may be practiced otherwise than as described.

What is claimed is:

1. An exhaust gas pressure reducer for an internal combustion engine comprising; a tubular member adapted to fit over the end of the exhaust pipe of said internal combustion engine; a housing having top and bottom plates mounted on said tubular member; a venturi in said housing, said venturi having a pair of inwardly flaring arcuate side members located intermediate said top and bottom plates and being in spaced apart relation to form a venturi throat approximately equal in cross-sectional area to the cross-sectional area of the end of said tubular member; air deflecting means at the exit of said venturi for deflecting air flowing around the external surface of said housing away from said exit to create a low pressure area at said exit to assist in discharging hot gases from said internal combustion engine.

2. The exhaust gas pressure reducer according to claim 1 wherein said air deflecting means comprises a flap directed away from the external surface of said housing at the exit of said venturi.

3. The exhaust gas pressure reducer according to claim 1 or 2 including a second venturi in series with said first venturi.

4. The exhaust gas pressure reducer according to claim 3 wherein said second venturi is perpendicular to the first.

5. The exhaust gas pressure reducer according to claim 4 wherein elongated slots are provided between said first and second venturis for drawing air through said second venturi.

6. The exhaust gas pressure reducer according to claim 1 wherein said housing includes air scoop means in the top and bottom of said housing at the exit to said venturi.

7. The exhaust gas pressure reducer according to claim 6 including deflecting means on said housing.

8. The exhaust gas pressure reducer according to claim 7 wherein said deflecting means comprises deflecting plates in the top and bottom of said housing at the exit.

* * * * *